US009922606B2

(12) United States Patent
Shangguan

(10) Patent No.: US 9,922,606 B2
(45) Date of Patent: Mar. 20, 2018

(54) DISPLAY DRIVING CIRCUIT AND DISPLAY DEVICE

(71) Applicant: Boe Technology Group Co., Ltd., Beijing (CN)

(72) Inventor: Xingchen Shangguan, Beijing (CN)

(73) Assignee: BOE TECHNOLOGY GROUP CO., LTD., Beijing (CN)

( * ) Notice: Subject to any disclaimer, the term of this patent is extended or adjusted under 35 U.S.C. 154(b) by 100 days.

(21) Appl. No.: 14/913,320

(22) PCT Filed: Aug. 20, 2015

(86) PCT No.: PCT/CN2015/087695
§ 371 (c)(1),
(2) Date: Feb. 19, 2016

(87) PCT Pub. No.: WO2016/161744
PCT Pub. Date: Oct. 13, 2016

(65) Prior Publication Data

US 2017/0039964 A1 Feb. 9, 2017

(30) Foreign Application Priority Data

Apr. 10, 2015 (CN) ..... 2015 2 0218125 U

(51) Int. Cl.
*G09G 3/36* (2006.01)
*G09G 3/20* (2006.01)

(52) U.S. Cl.
CPC ..... *G09G 3/3611* (2013.01); *G09G 3/2096* (2013.01); *G09G 3/36* (2013.01);
(Continued)

(58) Field of Classification Search
CPC ..... G09G 3/3611; G09G 3/2096; G09G 3/36; G09G 3/3406; G06F 13/20; G06F 13/374; G06F 13/409
(Continued)

(56) References Cited

U.S. PATENT DOCUMENTS 4,466,058 A * 8/1984 Girard ..... G06F 13/374 710/124
4,710,871 A * 12/1987 Belknap ..... H04L 1/1671 370/463
(Continued)

FOREIGN PATENT DOCUMENTS

CN 1346123 4/2002
CN 103345094 10/2013
(Continued)

OTHER PUBLICATIONS

International Search Report and Written Opinion from PCT/CN15/87695 dated Dec. 28, 2015.

*Primary Examiner* — Fred Tzeng
(74) *Attorney, Agent, or Firm* — Calfee, Halter & Griswold LLP

(57) ABSTRACT

The present invention provides a display driving circuit and a display device. The display driving circuit comprises a timing controller and a driving chip, and the timing controller comprises a first generation module and a first timing module. The first generation module is connected with the first timing module and the driving chip respectively, and configured to generate a row starting signal for triggering the first timing module to start timing and the driving chip which is idle to turn on. The first timing module is connected with the driving chip, and configured to trigger the driving chip which is idle in a non-effective pixel display duration to turn off, in case a current timing duration equals to an effective pixel display duration. The display driving circuit can pre-
(Continued)

vent an idle driving chip from staying in the on-state and consuming power, so that current requirements for energy saving against a display device can be satisfied, and the quality of display device can be improved.(FIG. 1)

13 Claims, 3 Drawing Sheets

(52) U.S. Cl.
CPC ... *G09G 3/3677* (2013.01); *G09G 2300/0408* (2013.01); *G09G 2310/0264* (2013.01); *G09G 2310/0289* (2013.01); *G09G 2310/08* (2013.01); *G09G 2330/021* (2013.01)

(58) Field of Classification Search
USPC ..... 345/213
See application file for complete search history.

(56) References Cited

U.S. PATENT DOCUMENTS 9,633,612 B2 * 4/2017 Duan ..... G09G 3/3406
2005/0216791 A1 * 9/2005 Liu ..... G06F 11/221 714/25
2006/0112197 A1 * 5/2006 Yao ..... G06F 13/409 710/15
2006/0294449 A1 * 12/2006 Ikeda ..... G06F 3/061 714/763
2007/0069774 A1 * 3/2007 Kim ..... G11C 7/1072 327/158
2008/0205173 A1 * 8/2008 Kliewer ..... G01R 31/3004 365/201
2009/0282177 A1 * 11/2009 Chen ..... G06F 13/20 710/110
2010/0274996 A1 * 10/2010 Park ..... G06F 1/06 712/221
2011/0001445 A1 * 1/2011 Wang ..... G05D 23/1917 318/473
2014/0376431 A1 * 12/2014 Li ..... H04W 52/0206 370/311

FOREIGN PATENT DOCUMENTS

CN 103680439 3/2014
CN 103680443 3/2014
CN 104464675 3/2015
CN 104496890 4/2015
CN 104538000 4/2015
CN 204496890 7/2015
KR 101076442 7/2006
KR 20110078711 7/2011

* cited by examiner

DISPLAY DRIVING CIRCUIT AND DISPLAY DEVICE

RELATED APPLICATIONS

The present application is the U.S. national phase entry of PCT/CN2015/087695 with an International filing date of Aug. 20, 2015, which claims the benefit of Chinese Application No. 201520218125.1, filed Apr. 10, 2015, the entire disclosures of which are incorporated herein by reference.

FIELD OF THE INVENTION

The present invention relates to the field of liquid crystal display technology, and particularly to a display driving circuit and a display device.

BACKGROUND OF THE INVENTION

Gate-driver On Array (GOA) is a technology which is currently applied in the field of liquid crystal display. In particular, in GOA, a gate driving chip is installed on an array substrate, so that cost of the gate driving chip is saved and a distance between a display pixel region at the gate side and a frame is reduced. However, GOA is required to be driven by a driving signal which has a voltage variation significantly larger than a general digital voltage range. Thereby, a level shift IC is connected between a timing controller (Tcon) and GOA. A driving signal which is generated by the timing controller for driving GOA is converted into the required GOA signal with a large voltage variation by means of the level shift IC.

However, a display driving circuit in which the above level shift IC is applied is subject to the following problems in practical applications. Since during display of each frame of picture, a number of display pixels set by a system (set pixels or v-total) is larger than the number of pixels which are actually displayed (effective pixel). The set pixels are displayed in a duration of one frame period, and the effective pixels are display in a duration less than one frame period. Therefore, there is an idle time between the end of the display of effective pixels of a frame and the start of a next frame (i.e., the difference between the frame period and the display duration of effective pixels). The idle time is referred to as non-effective pixel display duration (or blanking duration). Since in the blanking duration, the display driving circuit does not need to charge pixel units, but the level shift IC is still in an on-state. Namely, the level shift IC still consumes power, so that the current requirements for energy saving against a display device are not satisfied, and the display device has a poor quality.

Therefore, currently there is an urgent need for a display driver and a display device which has an improved energy-saving performance.

SUMMARY OF THE INVENTION

The present invention intends to at least solve one of the technical problems in the prior art, and proposes a display driving circuit and a display device, which can prevent an idle driving chip from staying in the on-state and consuming power, so that current requirements for energy saving against a display device can be satisfied, and the quality of display device can be improved.

To solve one of the above problems, the present invention provides a display driving circuit, comprising a timing controller and a driving chip, the timing controller comprises a first generation module and a first timing module; wherein the first generation module is connected with the first timing module and the driving chip respectively, and configured to generate a row starting signal for triggering the first timing module to start timing and the driving chip which is idle to turn on; the first timing module is connected with driving chip, and configured to trigger the driving chip which is idle in a non-effective pixel display duration to turn off, in case a current timing duration equals to an effective pixel display duration.

For example, the timing controller further comprises a second generation module and a second timing module, wherein the second generation module is connected with the second timing module, and configured to receive a data start-enabling jump signal for triggering the second timing module to start timing and receive the data stop-enabling jump signal for triggering the second timing module to stop timing; the second timing module is connected with the first timing module, and configured to record a current timing duration under triggering of the second generation module as a current effective pixel display duration of the first timing module.

The timing controller further comprises a clock module which is configured to output a clock signal of a predefined period; the clock module is connected with the first timing module and the second timing module respectively, the first timing module and the second timing module are configured to accumulate a period number of the clock signal as a timing duration during timing respectively.

The idle driving chip comprises a gate driving chip, a source driving chip, a level shift IC, or a power management chip.

The present invention further provides a display driving circuit, comprising a timing controller and a driving chip, the timing controller comprises a third generation module and a third timing module, wherein the third generation module is connected with the third timing module and the driving chip respectively, and configured to generate a row starting jump signal for triggering the third timing module to start timing and the driving chip which is idle to turn on, and generate a row ending jump signal trigger the driving chip which is idle in a non-effective pixel display duration to turn off; the third timing module is connected with the third generation module, and configured to trigger the third generation module to generate the row ending jump signal, in case a current timing duration equals to the effective pixel display duration.

For example, the timing controller further comprises a fourth generation module and a fourth timing module, wherein the fourth generation module is connected with the fourth timing module, and configured to receive a data start-enabling jump signal for triggering the fourth timing module to start timing and receive the data stop-enabling jump signal for triggering the fourth timing module to stop timing; the fourth timing module is connected with the third timing module, and configured to record a current timing duration under triggering of the fourth generation module as a current effective pixel display duration of the third timing module.

The timing controller further comprises a clock module which is configured to output a clock signal of a predefined period; the clock module is connected with the third timing module and the fourth timing module respectively, and the third timing module and the fourth timing module are configured to accumulate a period number of the clock signal as a timing duration during timing respectively.

The idle driving chip comprises a gate driving chip, a source driving chip, a level shift IC, or a power management chip.

The present invention further provides a display device, comprising a display driving circuit which adopts the first display driving circuit as mentioned above.

The present invention further provides a display device, comprise display driving circuit which adopts the second display driving circuit as mentioned above.

The present invention has the following beneficial effects.

A first display driving circuit of the present invention is connected with the first timing module and the driving chip respectively by means of the first generation module. The first generation module generates a row starting signal which triggers the first timing module to start timing and triggers the idle driving chip to turn on. The so-called row starting signal refers to a trigger signal which indicates the start of a frame of picture. The so-called idle driving chip refers to a driving chip which does not need to operate in the non-effective pixel display duration. The first display driving circuit is further connected with the driving chip by means of the first timing module, and, in case a current timing duration equals to an effective pixel display duration, the first timing module triggers the driving chip which is idle in a non-effective pixel display duration to turn off. Thus, by adopting the display driving circuit, the idle driving chip can be turned on in the effective pixel display duration to ensure the effective pixels output normally, and can be turned off in the non-effective pixel display duration to prevent the idle driving chip from staying in the on-state and consuming power, so that current requirements for energy saving against a display device can be satisfied, and the quality of display device can be improved.

A second display driving circuit of the present invention is connected with the third timing module and the driving chip respectively by means of the third generation module. The third generation module generates a row starting jump signal for triggering the third timing module to start timing and turn on the driving chip which is idle, and generates a row ending jump signal for triggering the driving chip which is idle in a non-effective pixel display duration to turn off. The so-called row starting jump signal refers to a jump signal which indicates the start of a frame of picture. The so-called row ending jump signal refers to a jump signal which indicates the end of the effective pixel display of a frame of picture. The so-called idle driving chip refers to a driving chip which does not need to operation in the non-effective pixel display duration. The second display driving circuit is further connected with the driving chip by means of the third timing module, and, in case a current timing duration equals to an effective pixel display duration, the third timing module triggers the third generation module to generate the row ending jump signal. Thus, by adopting the display driving circuit, the driving chip can be turned on in the effective pixel display duration to ensure the effective pixels output normally, and the idle driving chip can be turned off in the non-effective pixel display duration to prevent the idle driving chip from staying in the on-state and consuming power, so that current requirements for energy saving against a display device can be satisfied, and the quality of display device can be improved.

The present invention provides a first display device, which adopts the first display driving circuit as mentioned above, and can prevent an idle driving chip from staying in the on-state and consuming power, so that current requirements for energy saving against a display device can be satisfied, and the quality of display device can be improved.

The present invention provides a second display device, which adopts the second display driving circuit as mentioned above, and can prevent an idle driving chip from staying in the on-state and consuming power, so that current requirements for energy saving against a display device can be satisfied, and the quality of display device can be improved.

DETAILED DESCRIPTION OF THE INVENTION

In order to make objects, technical solutions and advantages of the present invention more clear, embodiments of the present invention will be described in details hereinafter in conjunction with the accompanying drawings.

Figure 1:
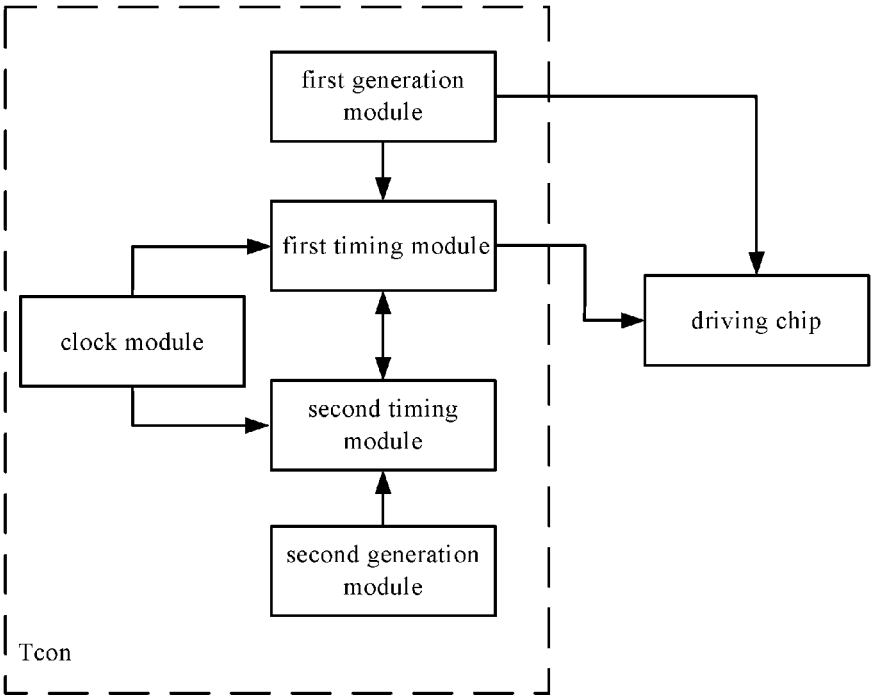
FIG. 1 is a schematic block diagram of a display driving circuit in a first embodiment of the present invention.
Figure 2:
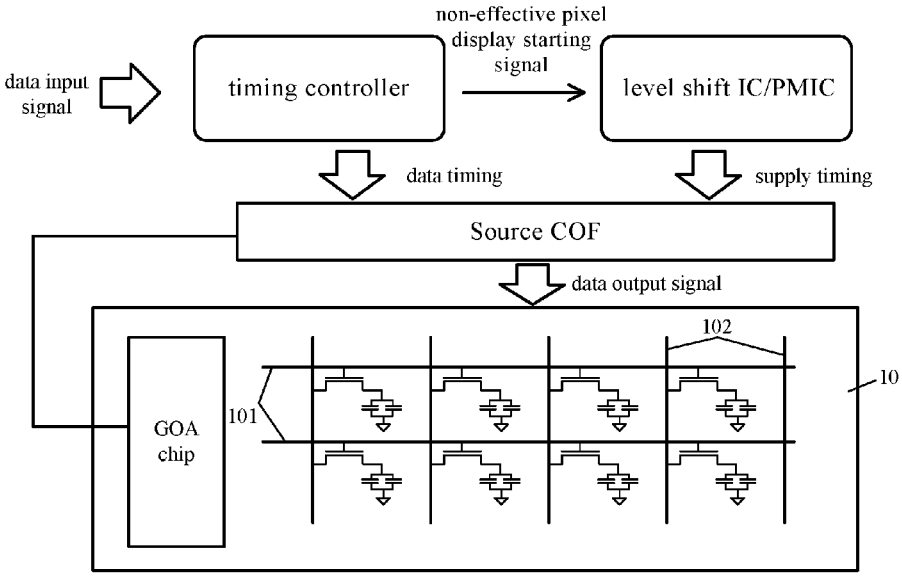
FIG. 2 is a schematic view of an application of the display driving circuit shown in FIG. 1.
Figure 3:
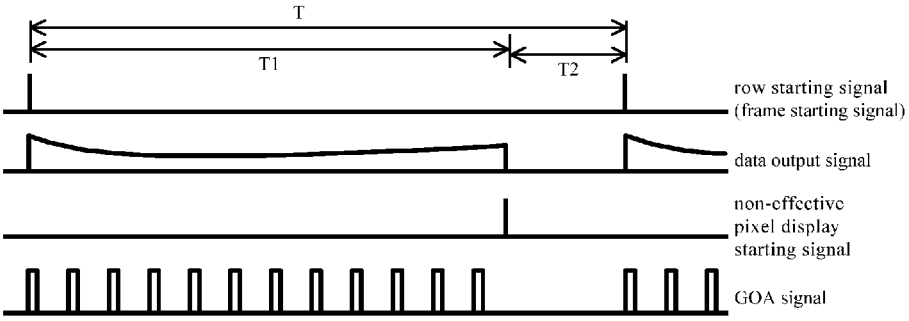
FIG. 3 is a timing diagram for a signal of the display driving circuit of FIG. 2.

FIG. 1 is a schematic block diagram of a display driving circuit in a first embodiment of the present invention, FIG. 2 is a schematic view of an application of the display driving circuit shown in FIG. 1, and FIG. 3 is a timing diagram for a signal of the display driving circuit of FIG. 2. Reference is made to FIG. 1, FIG. 2, and FIG. 3. In the present embodiment, the display driving circuit is configured to output a scan voltage signal and a data voltage signal, e.g. the data (Data) output signal in FIG. 3, to gate lines 101 and data lines 102 of an array substrate 10. In particular, the display driving circuit comprises a timing controller (Tcon) and a driving chip. The driving chip comprises a gate driving chip (GOA chip) on the array substrate 10, a source driving chip (Source COF) on a flexible circuit board, a level shift IC and a power management chip (PMIC) which are connected between the timing controller and the source driving chip, or the like. The level shift IC is connected with the gate driving chip by means of the source driving chip, and converts a driving signal for driving GOA generated by the timing controller into the required GOA signal with a large voltage variation.

The timing controller comprises a first generation module and a first timing module. The first generation module is connected with the first timing module and the driving chip respectively, and configured to generate a row starting signal for triggering the first timing module to start timing and the driving chip which is idle to turn on. Here, the row starting signal refers to a trigger signal which indicates the start of a frame of picture, and is also referred to as "a frame starting signal". The idle driving chip refers to a driving chip which does not need to operate in a non-effective pixel display duration T2. In particular, in the present embodiment, the idle driving chip can comprise a gate driving chip, a source driving chip, a level shift IC, and a power management chip. Thereby, the first timing module triggers the gate driving chip, the source driving chip, the level shift IC and/or the power management chip to turn on or off. It is understood that, the first timing module can turn on or off all or some idle driving chips according to connection relationship of a supply line for each idle driving chip in the practical display driving circuit. For example, if the power management chip is configured to supply power to all other idle driving chips, it is only required for the first timing module to turn on or off the power management chip, so as to turn on or off all idle driving chips.

The first timing module is connected with the driving chip, and configured to trigger the driving chip which is idle in the non-effective pixel display duration T2 to turn off, in case its current timing duration equals to an effective pixel display duration T1, wherein T1+T2=T, and T is a frame period. In this case, the signal by which the first timing module triggers the idle driving chip to turn off is referred to as a non-effective pixel display starting signal $S_{BlankingStart}$, as shown in FIG. 3.

The present invention does not intend to define the manner in which the first timing module triggers the idle driving chip to turn on or off. The idle driving chip can be triggered either directly or indirectly. In case the idle driving chip is triggered indirectly, the idle driving chip is triggered by other devices.

Thus, by adopting the display driving circuit, the idle driving chip can be turned on in the effective pixel display duration T1 to ensure the effective pixels output normally, and can be turned off in the non-effective pixel display duration T2 to prevent the idle driving chip from staying in the on-state and consuming power, so that current requirements for energy saving against a display device can be satisfied, and the quality of display device can be improved.

For example, in the present embodiment, the display driving circuit further comprises a second generation module and a second timing module. The second generation module is connected with the second timing module, and is configured to receive a data start-enabling jump signal for triggering the second timing module to start timing and receive a data stop-enabling jump signal for triggering the second timing module to stop timing. Here, the data start-enabling jump signal refers to a signal which indicates the start of an effective pixel display of a frame of picture, and specifically is a signal jumping from a low level to a high level. The data stop-enabling jump signal refers to a signal which indicates a deactivation of an effective pixel display of a frame of picture, and specifically is a signal jumping from the high level to the low level. Of course, in practical applications, the data start-enabling jump signal can further be a signal jumping from the high level to the low level. Accordingly, the data stop-enabling jump signal is a signal jumping from the low level to the high level.

The second timing module is connected with the first timing module, and configured to record a current timing duration under triggering of the second generation module as a current effective pixel display duration of the first timing module. Since the second timing module starts timing upon receipt of the data start-enabling jump signal and stops timing upon receipt of the data stop-enabling jump signal, during a frame period, the current effective pixel display duration gradually accumulates from an initial value to the effective pixel display duration T1.

It is understood that, the row starting signal generated by the first generation module is delayed by a certain time (which can be at least one clock period or one frame period) with respect to the data start-enabling turn off jump signal generated by the second generation module. In this way, the current effective pixel display duration can be obtained firstly, then the first timing module starts timing and it is determined whether its current timing duration equals to the effective pixel display duration T1.

Thus, by means of the second generation module and the second timing module, the effective pixel display duration T1 can be obtained automatically. Therefore, the display driving circuit of the present embodiment can be applied to a display device in which the effective pixel display duration T1 is unkonwn, thus improving applicability and practicability of the display driving circuit. Of course, in practical applications, it is also possible that a known effective pixel display duration T1 can be directly set in advance in the first timing module, and there is no need for the second generation module and the second timing module to obtain the effective pixel display duration T1 automatically.

Further, to realize timing of the first timing module and the second timing module, the display driving circuit of the present embodiment further comprises a clock module which is configured to output a clock signal of a predefined period. The clock module is connected with the first timing module and the second timing module respectively. The first timing module and the second timing module are respectively configured to accumulate the period number of clock signal during timing as a timing duration.

It is noted that, although the first timing module is configured to trigger the idle driving chip to turn off in the non-effective pixel display duration T2 in the present embodiment, the present invention is not limited to this. In practical applications, the first timing module can further trigger other devices which do not need to operate, such as a light source of a backlight module, to turn off in the non-effective pixel display duration T2.

Figure 4:
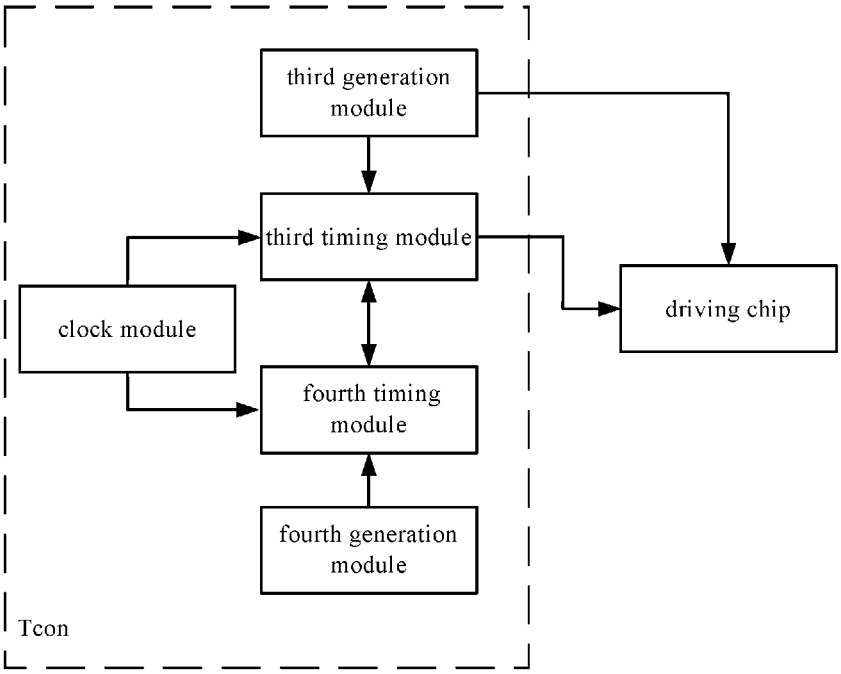
FIG. 4 is a schematic block diagram of a display driving circuit in a second embodiment of the present invention.
Figure 5:
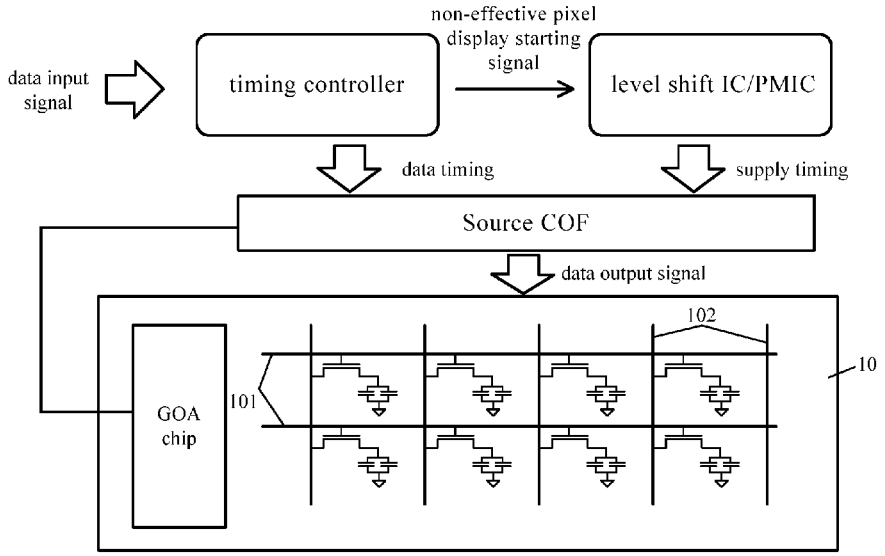
FIG. 5 is a schematic view of an application of the display driving circuit shown in FIG. 4.
Figure 6:
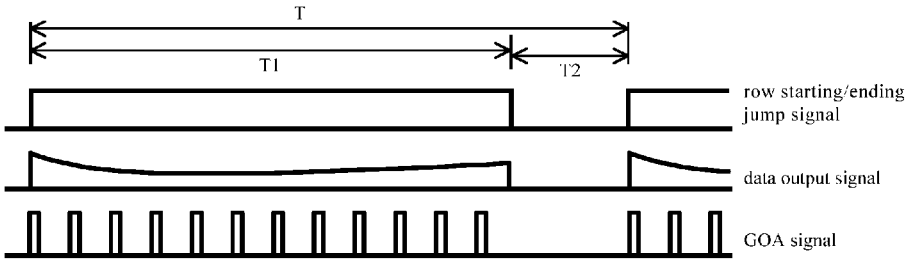
FIG. 6 is a timing diagram for a signal of the display driving circuit of FIG. 5.

FIG. 4 is a schematic block diagram of a display driving circuit in a second embodiment of the present invention, FIG. 5 is a schematic view of an application of the display driving circuit shown in FIG. 4, and FIG. 6 is a timing diagram for a signal of the display driving circuit of FIG. 5. Reference is made to FIG. 4, FIG. 5, and FIG. 6. In the present embodiment, the display driving circuit is configured to output a scan voltage signal and a data voltage signal, e.g. the data (Data) output signal in FIG. 6, to gate lines 101 and data lines 102 of an array substrate 10. In particular, the display driving circuit comprises a timing controller (Tcon) and a driving chip. The driving chip comprises a gate driving chip (GOA chip) on the array substrate 10, a source driving chip on a flexible circuit board, a level shift IC and a power management chip which are connected between the timing controller and the source driving chip, or the like. The level shift IC is connected with the gate driving chip by means of the source driving chip, and converts a driving signal for driving GOA generated by the timing controller into the required GOA signal with a large voltage variation.

The timing controller comprises a third generation module and a third timing module. The third generation module is connected with the third timing module and the driving chip respectively, and is configured to generate a row starting jump signal for triggering the third timing module to start timing and the driving chip which is idle to turn on, and generate a row ending jump signal for triggering the driving chip which is idle in the non-effective pixel display duration T2 to turn off. Here, the row starting jump signal refers to a jump signal which indicates the start of a frame of picture. The row ending jump signal refers to a jump signal which indicates the end of an effective pixel display of a frame of picture. In particular, the signal by which the third generation module triggers the driving chip to turn on or off is referred to as "a row starting/ending jump signal". As shown in FIG. 6, the row starting jump signal specifically is a signal jumping from a low level to a high level, and the row ending jump signal specifically is a signal jumping from the high level to the low level. Of course, in practical applications, the row starting jump signal can further be a signal jumping from the high level to the low level. Accordingly, the row ending jump signal is a signal jumping from the low level to the high level.

The idle driving chip refers to a chip which does not need to operate in the non-effective pixel display duration T2, and can comprise a gate driving chip, a source driving chip, a level shift IC, and a power management chip. Thereby, the third generation module triggers the gate driving chip, the source driving chip, the level shift IC and/or the power management chip to turn on or off. It is understood that, the third timing module can turn on or off all or some idle driving chips according to connection relationship of a supply line for each idle driving chip in the practical display driving circuit. For example, if the power management chip is configured to supply power to all other idle driving chips, it is only required for the third timing module to turn on or off the power management chip, so as to turn on or off all idle driving chips.

The third timing module is connected with the third generation module, and configured to trigger the third generation module to generate a row ending jump signal, in case its current timing duration equals to the effective pixel display duration T1, wherein T1+T2=T, and T is a frame period.

The present invention does not intend to define the manner in which the third timing module triggers the idle driving chip to turn on or off. The idle driving chip can be triggered either directly or indirectly. In case the idle driving chip is triggered indirectly, the idle driving chip is triggered by other devices.

Thus, by adopting the display driving circuit, the idle driving chip can be turned on in the effective pixel display duration T1 to ensure the effective pixels output normally, and can be turned off in the non-effective pixel display duration T2 to prevent the idle driving chip from staying in the on-state and consuming power, so that current requirements for energy saving against a display device can be satisfied, and the quality of display device can be improved.

For example, in the present embodiment, the display driving circuit further comprises a fourth generation module and a fourth timing module. The fourth generation module is connected with the fourth timing module, and is configured to receive a data start-enabling jump signal for triggering the fourth timing module to start timing, and receive a data stop-enabling jump signal for triggering the fourth timing module to stop timing. Here, the data start-enabling jump signal refers to a signal which indicates the start of an effective pixel display of a frame of picture, and specifically is a signal jumping from a low level to a high level. The data stop-enabling jump signal refers to a signal which indicates a deactivation of an effective pixel display of a frame of picture, and specifically is a signal jumping from the high level to the low level. Of course, in practical applications, the data start-enabling jump signal can further be a signal jumping from the high level to the low level. Accordingly, the data stop-enabling jump signal is a signal jumping from the low level to the high level.

The fourth timing module is connected with the third timing module, and configured to record a current timing duration under triggering of the fourth generation module as a current effective pixel display duration of the third timing module. Since the fourth timing module starts timing upon receipt of the data start-enabling jump signal and stops timing upon receipt of the data stop-enabling jump signal, during a frame period, the current effective pixel display duration gradually accumulates from an initial value to the effective pixel display duration T1.

It is understood that, the row starting/ending jump signal generated by the third generation module is delayed by a certain time (which can be at least one clock period or one frame period) with respect to the data start-enabling turn off jump signal generated by the fourth generation module. In this way, the current effective pixel display duration can be obtained firstly, then the third timing module starts timing and it is determined whether its current timing duration equals to the effective pixel display duration T1.

Thus, by means of the fourth generation module and the fourth timing module, the effective pixel display duration T1 can be obtained automatically. Therefore, the display driving circuit of the present embodiment can be applied to a display device in which the effective pixel display duration T1 is unknown, thus improving applicability and practicability of the display driving circuit. Of course, in practical applications, it is also possible that a known effective pixel display duration T1 can be directly set in advance in the first timing module, and there is no need for the second generation module and the second timing module to obtain the effective pixel display duration T1 automatically.

Further, to realize timing of the third timing module and the fourth timing module, the display driving circuit of the present embodiment further comprises a clock module which is configured to output a clock signal of a predefined period. The clock module is connected with the third timing module and the fourth timing module respectively. The third timing module and the fourth timing module are respectively configured to accumulate the period number of clock signal during timing as a timing duration.

It is noted that, although the third timing module is configured to trigger the idle driving chip to turn off in the non-effective pixel display duration T2 in the present embodiment, the present invention is not limited to this. In practical applications, the third timing module can further trigger other devices which do not need to operate, such as a light source of a backlight module, to turn off in the non-effective pixel display duration T2.

As another technical solution, the present invention provides a display device, which comprises the display driving circuit of the first embodiment.

The display device of the present embodiment adopts the display driving circuit of the first embodiment, and can prevent an idle driving chip from staying in the on-state and consuming power, so that current requirements for energy saving against a display device can be satisfied, and the quality of display device can be improved.

As a further technical solution, the present invention provides a display device, which comprises the display driving circuit of the second embodiment.

The display device of the present embodiment adopts the display driving circuit of the second embodiment, and can prevent an idle driving chip from staying in the on-state and consuming power, so that current requirements for energy saving against a display device can be satisfied, and the quality of display device can be improved.

Although the present invention has been described above with reference to specific embodiments, it should be understood that the limitations of the described embodiments are merely for illustrative purpose and by no means limiting. Instead, the scope of the invention is defined by the appended claims rather than by the description, and all variations that fall within the range of the claims are intended to be embraced therein. Thus, other embodiments than the specific ones described above are equally possible within the scope of these appended claims.

The invention claimed is:

1. A display driving circuit, comprising:

a timing controller; and a driving chip;

wherein the timing controller comprises a first generation module and a first timing module;

wherein the first generation module is connected with the first timing module and the driving chip, and wherein the first generation module is configured to generate a signal for triggering the first timing module to start timing and the driving chip which is idle to turn on;

wherein the first timing module is connected with the driving chip, and wherein the first timing module is configured to trigger the driving chip which is idle in a non-effective pixel display duration to turn off when a current timing duration is equal to an effective pixel display duration;

wherein the timing controller further comprises a second generation module and a second timing module;

wherein the second generation module is connected with the second timing module, and wherein the second generation module is configured to receive a data start-enabling jump signal for triggering the second timing module to start timing and to receive a data stop-enabling jump signal for triggering the second timing module to stop timing; and wherein the second timing module is connected with the first timing module, and wherein the second timing module is configured to record a current timing duration as a current effective pixel display duration of the first timing module when triggered by the second generation module.

2. The display driving circuit of claim 1, wherein the timing controller further comprises:

a clock module configured to output a clock signal having a predefined period;

wherein the clock module is connected with the first timing module and the second timing module, and wherein the first timing module and the second timing module are each configured to accumulate a period number of the clock signal as a timing duration during timing.

3. The display driving circuit of claim 1, wherein the timing controller further comprises:

a clock module configured to output a clock signal having a predefined period;

wherein the clock module is connected with the first timing module and the second timing module, and wherein the first timing module and the second timing module are each configured to accumulate a period number of the clock signal as a timing duration during timing.

4. The display driving circuit of claim 1, wherein the idle driving chip comprises at least one of a gate driving chip, a source driving chip, a level shift IC, and a power management chip.

5. A display driving circuit, comprising:

a timing controller; and a driving chip;

wherein the timing controller comprises a third generation module a third timing module;

wherein the third generation module is connected with the third timing module and the driving chip, and wherein the third generation module Is configured to generate a row starting jump signal for triggering the third timing module to start timing and the driving chip which is idle to turn on, and to generate a row ending jump signal for triggering the driving chip which is idle in a non-effective pixel display duration to turn off;

wherein the third timing module is connected with the third generation module, and wherein the third timing module is configured to trigger the third generation module to generate the row ending jump signal when a current timing duration is equal to an effective pixel display duration;

wherein the timing controller further comprises a fourth generation module and a fourth timing module;

wherein the fourth generation module is connected with the fourth timing module, and wherein the fourth generation module is configured to receive a data start-enabling jump signal for triggering the fourth timing module to start timing, and to receive a data stop-enabling jump signal for triggering the fourth timing module to stop timing; and wherein the fourth timing module is connected with the third timing module, and wherein the fourth timing module is configured to record a current timing duration as a current effective pixel display duration of the third timing module when triggered by the fourth generation module.

6. The display driving circuit of claim 5, wherein the timing controller further comprises:

a clock module which is configured to output a clock signal having a predefined period;

wherein the clock module is connected with the third timing module and the fourth timing module, and wherein the third timing module and the fourth timing module are each configured to accumulate a period number of the clock signal as a timing duration during timing.

7. The display driving circuit of claim 5, wherein the timing controller further comprises:

a clock module which is configured to output a clock signal having a predefined period;

wherein the clock module is connected with the third timing module and the fourth timing module, and wherein the third timing module and the fourth module are each configured to accumulate a period number of the clock signal as a timing duration caring timing.

8. The display driving circuit of claim 5, wherein the idle driving chip comprises at least one of a gate driving chip, a source driving chip, a level shift IC, and a power management chip.

9. A display device, comprising:

a display driving circuit comprising a timing controller and a driving chip;

wherein the timing controller comprises a first generation module and a first timing module;

wherein the first generation module is connected with the first timing module and the driving chip, and wherein the first generation module is configured to generate a signal for triggering the first timing module to start timing and the driving chip which is idle to turn on;

wherein the first timing module is connected with the driving chip, and configured to trigger the driving chip which is idle in a non-effective pixel display duration to turn off, in case a current timing duration equals to an effective pixel display duration;

wherein the timing controller further comprises a second generation module and a second timing module;

wherein the second generation module is connected with the second timing module, and wherein the second generation module is configured to receive data start-enabling jump signal for triggering the second timing module to start timing and to receive a data stop-enabling jump signal for triggering the second timing module to stop timing; and wherein the second timing module is connected with the first timing module, and wherein the second timing module is configured to record a current timing duration as a current effective pixel display duration of the first timing module when triggered by the second generation module.

10. The display device of claim 9, wherein the timing controller further comprises:

a clock module which is configured to output a clock signal having a predefined period;

wherein the clock module is connected with the first timing module and the second timing module, and wherein the first timing module and the second timing module are each configured to accumulate a period number of the deck signal as a timing duration during timing.

11. The display device of claim 9, wherein the timing controller further comprises:

a clock module which is configured to output a clock signal having a predefined period;

wherein the clock module is connected with the first timing module and the second timing module, and wherein the first timing module and the second timing module are each configured to accumulate a period number of the clock signal as a timing duration during timing.

12. The display device of claim 9, wherein the idle driving chip comprises at least one of a gate driving chip, a source driving chip, a level shift IC, and a power management chip.

13. A display device, comprising:

a display driving circuit comprising a timing controller and a driving chip;

wherein the timing controller comprises a third generation module and a third timing module;

wherein the third generation module is connected with the third timing module and the driving chip, and wherein the third generation module is configured to generate a row starting jump signal for triggering the third timing module to start timing and the driving chip which is idle to turn on, and to generate a row ending jump signal for triggering the driving chip which is idle in a non-elective pixel display duration to turn off;

wherein the third timing module is connected with the third generation module, and wherein the third timing module is configured to trigger the third generation module to generate the row ending jump signal when a current timing duration is equal to an effective pixel display duration;

wherein the timing controller further comprises a fourth generation module and a fourth timing module;

wherein the fourth generation module is connected with the fourth timing module, and wherein the fourth generation module is configured to receive a data start-enabling jump signal for triggering the fourth timing module to start timing, and to receive a data stop-enabling jump signal for triggering the fourth timing module to stop timing; and wherein the fourth timing module is connected with the third timing module, and wherein the four timing module is configured to record a current timing duration as a current effective pixel display duration of the third timing module when triggered by the fourth generation module.

* * * * *